US008220282B2

(12) United States Patent
Hast et al.

(10) Patent No.: US 8,220,282 B2
(45) Date of Patent: Jul. 17, 2012

(54) DUAL-CONNECTION DRAIN PAN

(75) Inventors: Steven E. Hast, Lynn Haven, FL (US); Gerald T. Rubitski, Lynn Haven, FL (US)

(73) Assignee: Trane International Inc., Piscataway, NJ (US)

( * ) Notice: Subject to any disclaimer, the term of this patent is extended or adjusted under 35 U.S.C. 154(b) by 418 days.

(21) Appl. No.: 12/657,718

(22) Filed: Jan. 26, 2010

(65) Prior Publication Data

US 2011/0179818 A1 Jul. 28, 2011

(51) Int. Cl.
*F25D 21/14* (2006.01)

(52) U.S. Cl. ..... 62/285; 62/291

(58) Field of Classification Search ..... 62/285, 62/288, 290, 291, 272, 419; 454/141, 147, 454/186; 165/DIG. 195, DIG. 212, 127, 165/150, 179
See application file for complete search history.

(56) References Cited

U.S. PATENT DOCUMENTS 1,887,313 A 11/1932 Larkin
3,596,475 A 8/1971 Berger
4,098,093 A * 7/1978 Czyl ..... 62/243
4,474,232 A 10/1984 Wright et al.
4,687,604 A * 8/1987 Goettl ..... 261/29
4,835,984 A * 6/1989 Vyavaharkar et al. ..... 62/285
4,907,420 A * 3/1990 Mahanay et al. ..... 62/291
4,916,919 A * 4/1990 Kim ..... 62/272
4,974,421 A * 12/1990 Kim ..... 62/272
5,046,330 A * 9/1991 Kim ..... 62/289
5,207,074 A * 5/1993 Cox et al. ..... 62/285
5,904,053 A 5/1999 Polk et al.
5,966,959 A 10/1999 Stewart
5,987,909 A * 11/1999 Martin, Sr. ..... 62/291
6,167,717 B1 * 1/2001 Dudley et al. ..... 62/291
6,718,788 B1 * 4/2004 Shuck ..... 62/291
6,901,766 B1 * 6/2005 Jin et al. ..... 62/286
6,978,909 B2 * 12/2005 Goetzinger et al. ..... 220/571

* cited by examiner

*Primary Examiner* — Mohammad Ali
(74) *Attorney, Agent, or Firm* — William O'Driscoll

(57) ABSTRACT

A refrigerant system includes a dual-connection drain pan for collecting and draining condensate from the exterior surface of a cooling coil. The drain pan includes a first channel and a second channel disposed alongside each other and sloped lengthwise in opposite directions to direct the condensate to either one of two drain outlets at opposite ends of the pan. To drain the condensate to a first outlet, a breakaway removable dam between the two channels is left intact to isolate the second channel from condensate so that the condensate drains from the first channel to the first outlet. Permanently removing the breakaway dam and plugging the first outlet allows condensate to drain from the first channel, into the second channel, and out through the second outlet. In some embodiments, the drain pan, including the two channels and breakaway dam, is formed of a unitary piece of a thermoset polymer.

20 Claims, 6 Drawing Sheets

DUAL-CONNECTION DRAIN PAN

BACKGROUND OF THE INVENTION

1. Field of the Invention

The subject invention generally pertains to HVAC refrigerant systems and more specifically to a condensate drain pan for such a system.

2. Description of Related Art

Refrigerant systems often include a cooling coil for cooling a stream of air. As the air flows across the coil, moisture from the air condenses on the coil and then drains into a collection pan. The pan usually includes an outlet for draining the condensate from the pan.

Examples of such systems are disclosed in U.S. Pat. No. 1,887,313 (Larkin); U.S. Pat. No. 3,596,475 (Berger); U.S. Pat. No. 4,474,232 (Wright et al.); U.S. Pat. No. 5,904,053 (Polk et al.) and U.S. Pat. No. 5,966,959 (Steward). Larkin shows a refrigerated showcase with a sloped drip pan, Berger and Wright et al. show heat exchangers that can be installed either in vertical or horizontal positions, Polk et al. discloses a drain pan with alternate drain openings, and Stewart discloses a drain pan that is sloped by way of a lifting portion.

Although the aforementioned systems are useful in certain applications, they do have their limitation.

SUMMARY OF THE INVENTION

It is an object of some embodiments of the invention to provide a refrigerant system with a drain pan that can be selectively configured to direct condensate to one or a plurality of multiple drain outlets.

Another object of some embodiments is to make such a drain pan of a unitary piece of material with a breakaway piece that determines to which drain outlet the condensate flows.

Another object of some embodiments is to provide a refrigerant system with drain outlets at opposite sides of the unit, yet the system includes a generally linear drain pan having a high point and a low point that are in physical proximity with each other.

Another object of some embodiments is to provide a dual-channel drain pan, wherein air flowing across the drain pan urges condensate to drain into a downwind channel of the pan.

Another object of some embodiments is to provide a refrigerant system with a condensate drain pan having a lower thermal conductivity than a cooling coil that is in intimate contact with the pan.

Another object of some embodiments is to make a condensate drain pan of a thermoset polymer so that the pan can withstand the heat from an adjacent heater.

One or more of these and/or other objects of the invention are provided by a refrigerant system that is subject to condensate. The present invention provides a refrigerant system comprising a cooling coil with a drain pan disposed underneath the coil. The drain pan is at a position to collect condensate draining from the cooling coil. The drain pan includes a first channel and a second channel. The first channel slopes downward in a first direction from a high point to an intermediate area, and the second channel slopes downward in a second direction from the intermediate area to a low point. A dam is selectively disposable at an intact position and a dislodged position such that in the intact position the dam is at the intermediate area to block condensate from flowing from the first channel to the second channel. In the dislodged position, the dam allows condensate to flow from the first channel to the second channel.

The present invention also provides a refrigerant system subject to condensate, wherein the refrigerant system comprises a cooling coil and a drain pan disposed underneath the cooling coil at a position to collect condensate draining from the cooling coil. The drain pan includes a first channel and a second channel. The first channel slopes downward in a first direction from a high point to an intermediate area. The second channel slopes downward in a second direction from the intermediate area to a low point, wherein the high point is closer to the low point than to the intermediate area. A dam selectively is disposable at an intact position and a dislodged position such that in the intact position the dam is at the intermediate area to block condensate from flowing from the first channel to the second channel, and in the dislodged position the dam is spaced apart from the intermediate area and allows condensate to flow from the first channel to the second channel. A breakable connection connects the dam to the intermediate area such that moving the dam from the intact position to the dislodged position involves permanently breaking the breakable connection.

The present invention further provides a refrigerant system subject to condensate, wherein the refrigerant system comprises a cooling coil and a drain pan. The drain pan comprises a monolithic unitary piece of a thermoset polymer that has a lower thermal conductivity than that of the cooling coil. The drain pan is disposed underneath the cooling coil at a position to collect condensate draining from the cooling coil. The drain pan includes a first channel and a second channel. The first channel slopes downward in a first direction from a high point to an intermediate area. The second channel slopes downward in a second direction from the intermediate area to a low point, wherein the high point is closer to the low point than to the intermediate area. The drain pan defines a first drain outlet in proximity with the intermediate area and a second drain outlet in proximity with the low point. The drain pan defines a return air inlet and a supply air outlet. The first channel and the second channel are situated between the return air inlet and the supply air outlet. A dam is selectively disposable at an intact position and a dislodged position such that in the intact position the dam is at the intermediate area to block condensate from flowing from the first channel to the second channel. In the dislodged position, the dam is spaced apart from the intermediate area and allows condensate to flow from the first channel to the second channel. A breakable connection connects the dam to the intermediate area such that moving the dam from the intact position to the dislodged position involves permanently breaking the breakable connection. A blower supported by the drain pan creates a current of air flowing from the return air inlet to the supply air outlet. The second channel is upwind of the first channel with respect to the current of air.

DESCRIPTION OF THE PREFERRED EMBODIMENT

Figure 1:
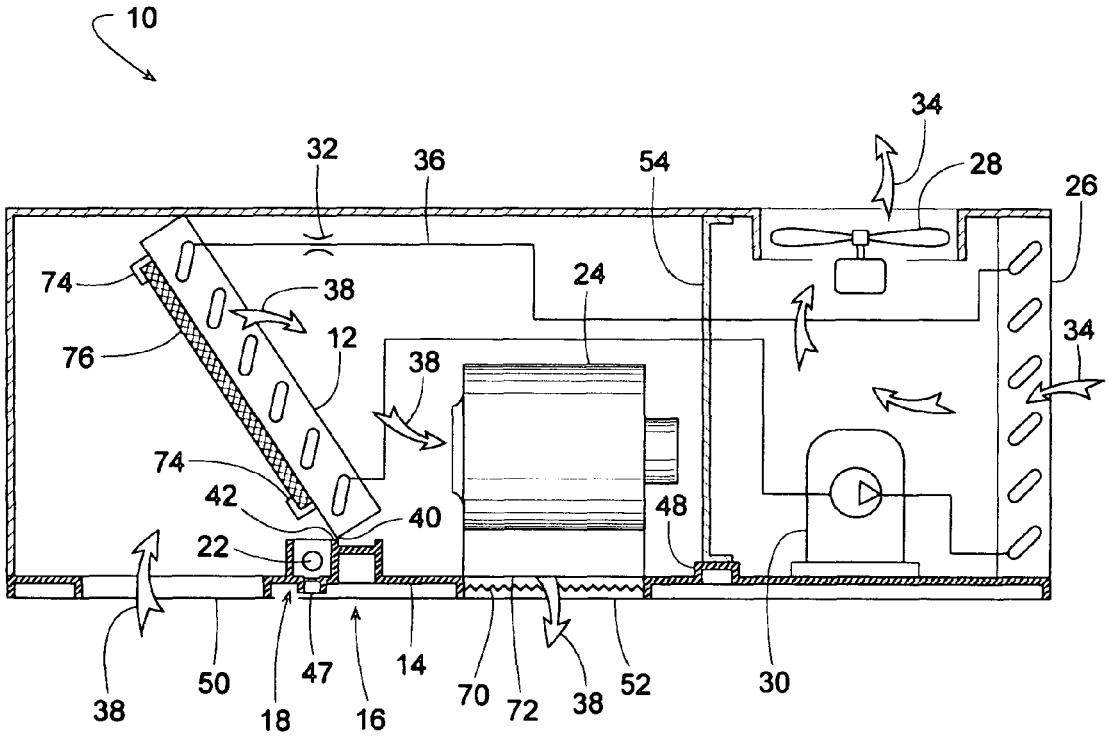
FIG. 1 is a schematic cross-sectional side view of a refrigerant system that includes a drain pan according to at least one embodiment of the invention.
Figure 2:
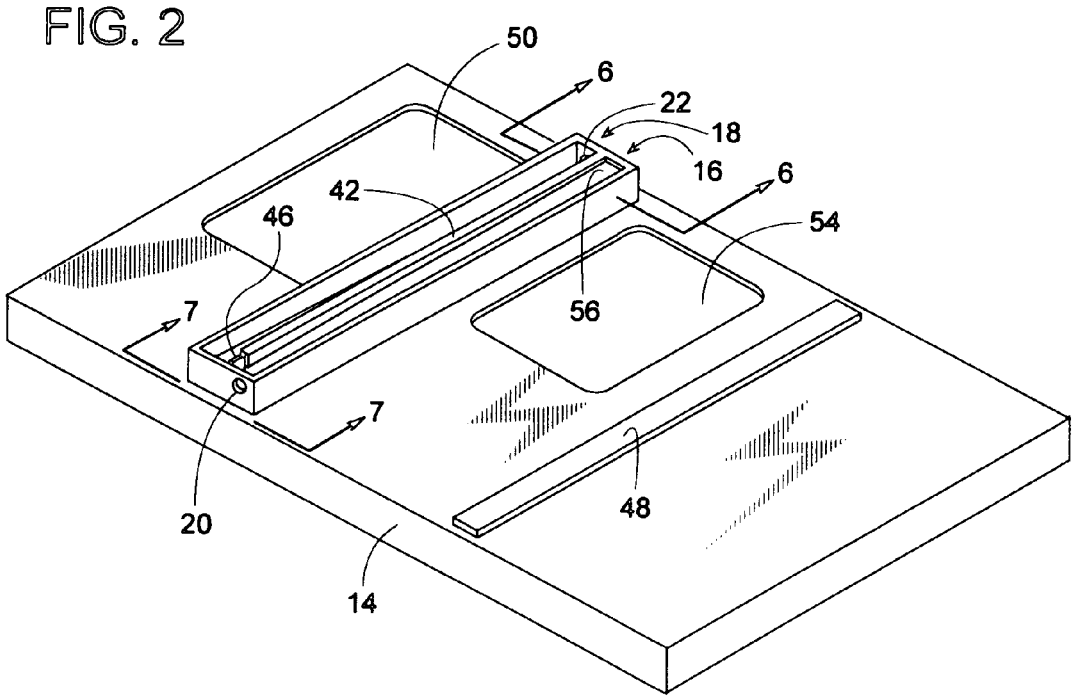
FIG. 2 is a perspective view of the drain pan shown in FIG. 1 with a dam of the pan in its intact position.
Figure 3:
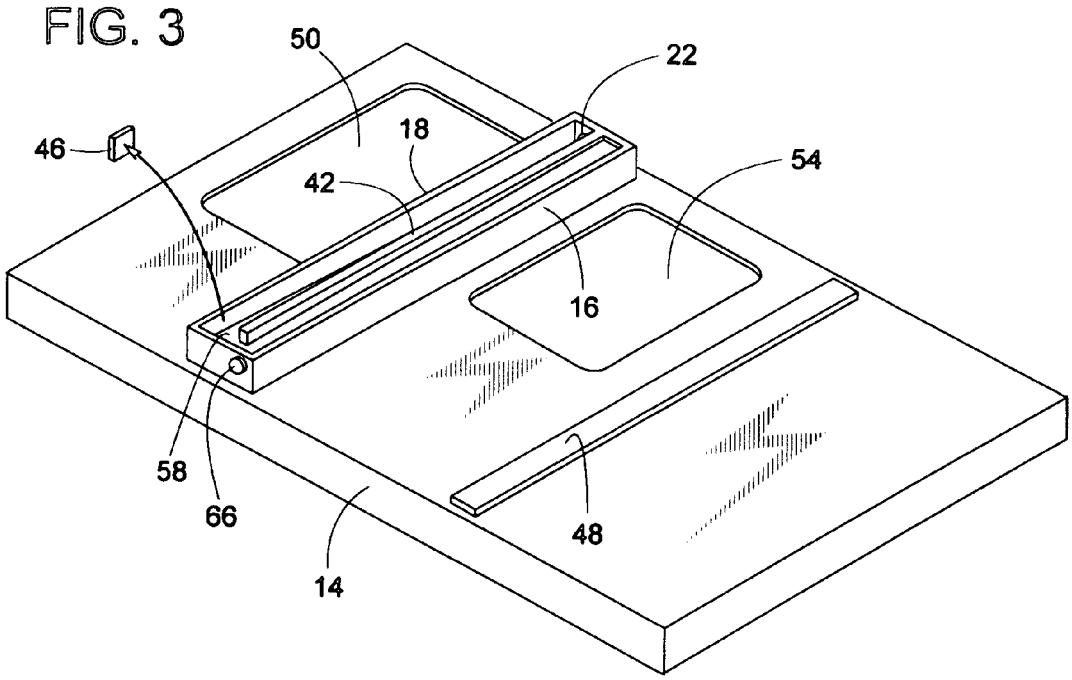
FIG. 3 is a perspective view of the drain pan shown in FIG. 1 with the dam of the pan in its dislodged position.
Figure 4:
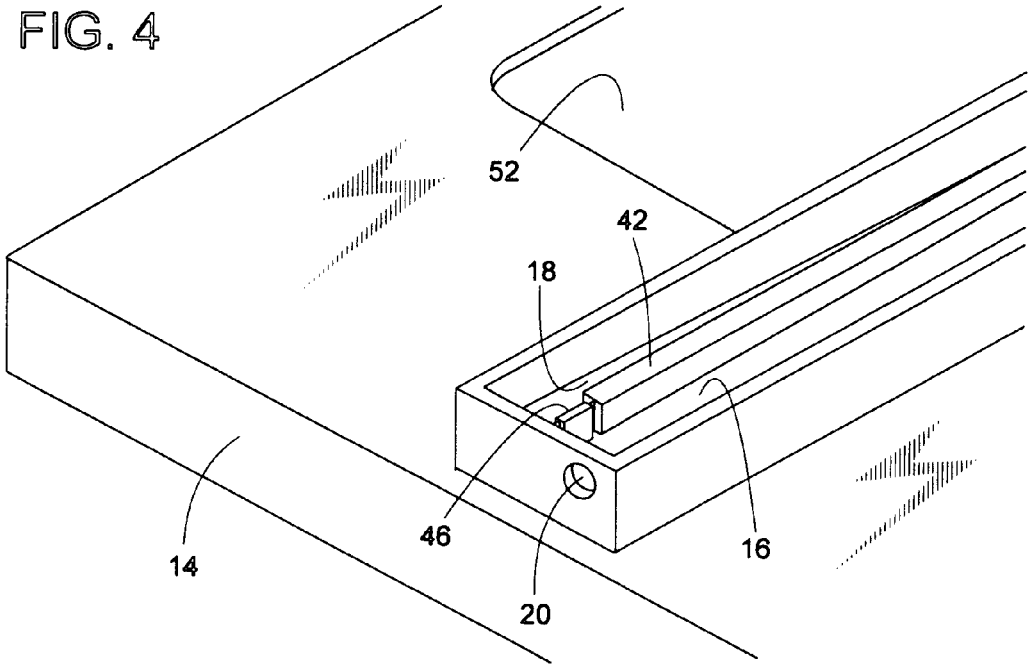
FIG. 4 is a closer-up perspective view of FIG. 2.
Figure 5:
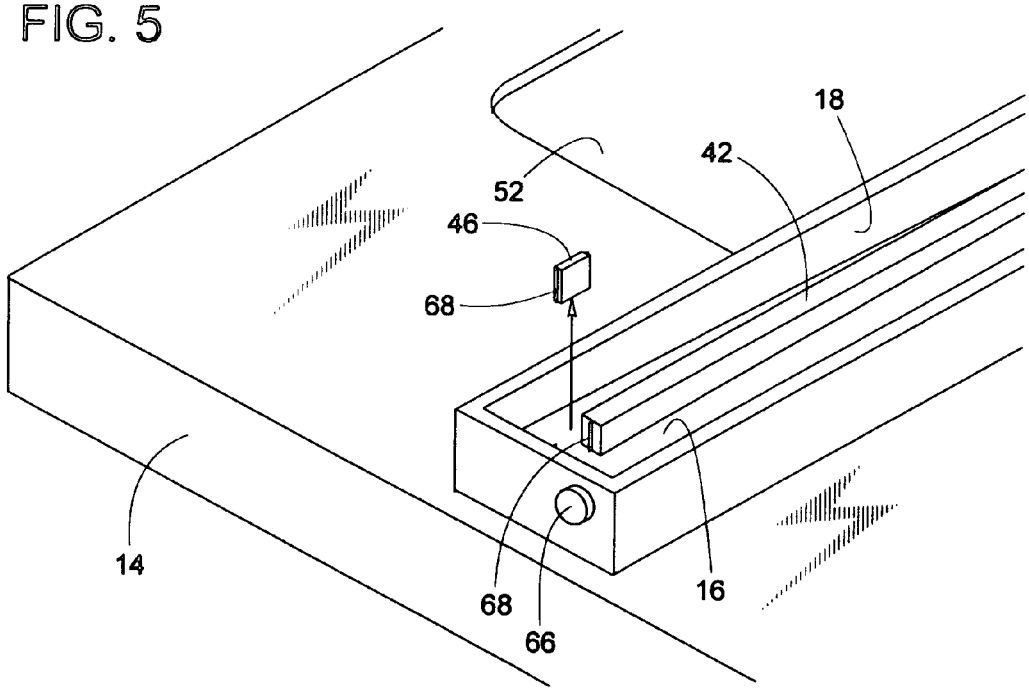
FIG. 5 is a closer-up perspective view of FIG. 3.
Figure 6:
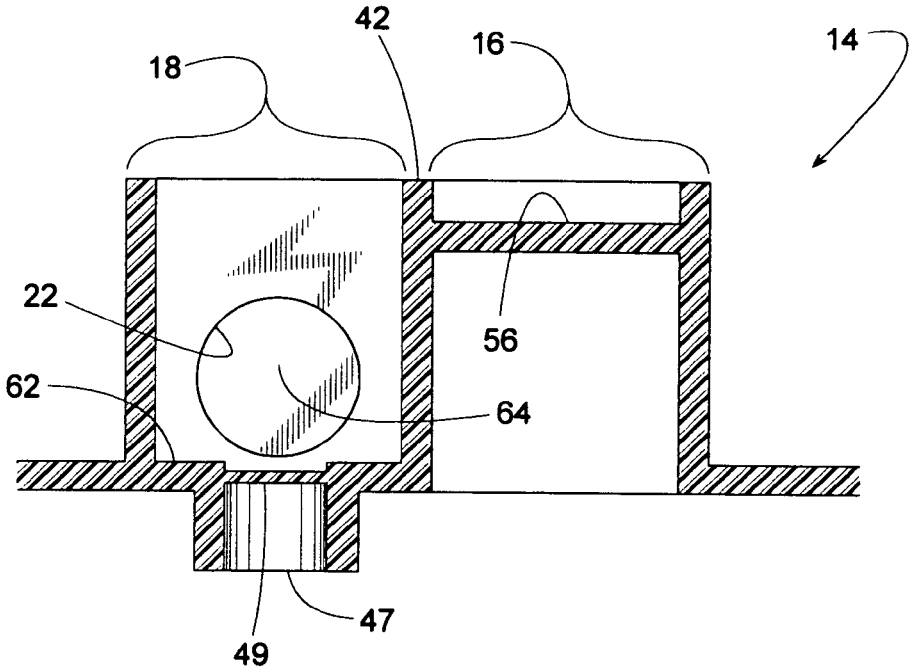
FIG. 6 is a cross-sectional view taken along line 6-6 of FIG. 2.
Figure 7:
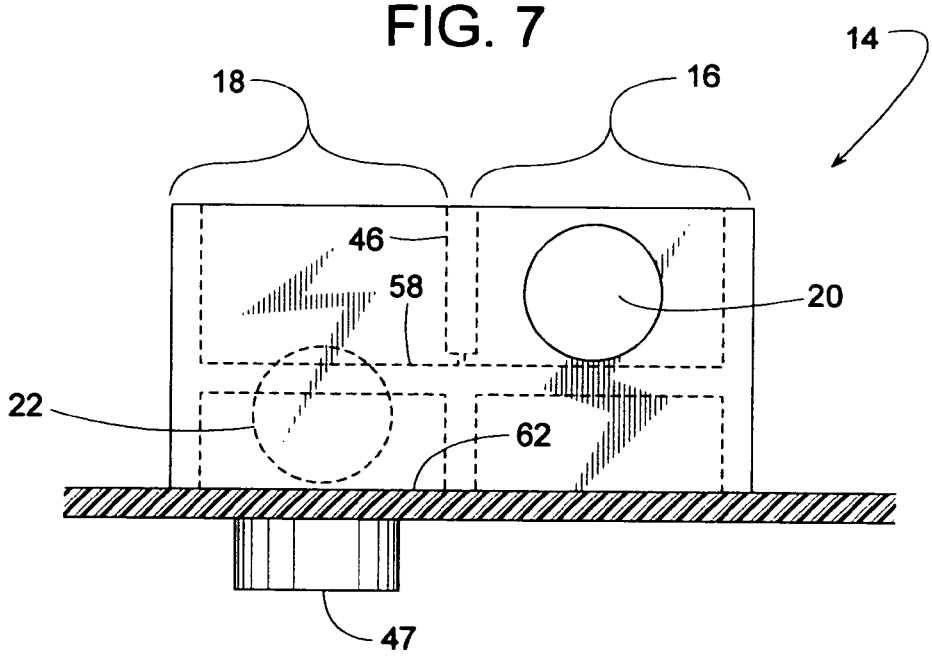
FIG. 7 is a cross-sectional view taken along line 7-7 of FIG. 2.

FIG. 1 illustrates a refrigerant system 10 that includes a cooling coil 12 and a drain pan 14, wherein cooling coil 12 represents any refrigerant evaporator or liquid chilled heat exchanger subject to condensate, and drain pan 14 collects the condensate from coil 12. With further reference to FIGS. 2-9, drain pan 14 includes a first channel 16 and a second channel 18 for directing the collected condensate to either a first drain outlet 20 or a second drain outlet 22, respectively. Having a choice of outlet 20 or outlet 22 for horizontal access, plus perhaps an optional outlet 47 for vertical access, can make it easier to run piping to drain pan 14 during the initial installation of system 10.

The specific design of system 10 may vary considerably, and the illustrated design is merely for sake of example. In this example, system 10 comprises cooling coil 12, a blower 24, an outdoor coil 26, an outdoor fan 28, a refrigerant compressor 30, and an expansion device 32 (e.g., expansion valve, capillary, orifice, or some other flow restriction). When operating in a cooling mode, compressor 30 forces refrigerant to flow sequentially through outdoor coil 26, expansion device 32, cooling coil 12 and back to the suction side of compressor 30. Outdoor fan 28 forces outside air 34 across outdoor coil 26 to cool the refrigerant in coil 26. A line 36 conveys the now-cooler refrigerant from outdoor coil 26 to cooling coil 12. As the refrigerant passes through expansion device 32 in line 36, the refrigerant cools by expansion, which cools coil 12. To make use of this cooling effect, blower 24 forces a current of air 38 across coil 12 to cool air 38. Blower 24 then forces the cooled air 38 to a comfort zone, such a room or other area of a building.

As relatively warm air passes through cooling coil 12, moisture in the air may condense on coil 12. In some embodiments of the invention, due to the position of a lowest edge 40 (or lower surface) of cooling coil 12 and intimate sealing between edge 40 and a dividing wall 42 of drain pan 14, the resulting condensate 44 from coil 12 first drains into first channel 16 of drain pan 14. Such intimate sealing between edge 40 and dividing wall 42 can be achieved by direct intimate contact between edge 40 and wall 42 or by a seal member interposed between edge 40 and wall 42. Such a seal member allows greater flexibility in the placement of coil 12 relative to drain pan 14. Second channel 18 being upwind of air 38 further ensures that condensate 44 first drains to first channel 16. From first channel 16, condensate 44 then either drains directly out through first drain outlet 20 or flows next through second channel 18 and then out through second drain outlet 22. The presence or removal of a dam 46 between channels 16 and 18 determines the flow path of condensate 44.

Some examples of the invention include the third optional drain outlet 47 for directing condensate directly downward. To selectively use or disregard drain outlet 47, drain pan 14 may include a removable obstruction 49, such as a plug, cap or breakaway membrane. For sake of example, the drawing figures show obstruction 49 as a relatively thin breakaway membrane.

For the example shown in FIGS. 1-9, drain pan 14 is made of a monolithic unitary piece of a thermoset polymer (e.g., glass-filled polyester), thus channels 16 and 18, a support boss 48, dam 46 in its intact position (FIGS. 2, 4, 7 and 8), and the portions of pan 14 that define a return air inlet 50 and a supply air outlet 52 are of a single piece of material. Support boss 48 schematically represents any of a plurality of elevated or recessed areas that help support various components including, but not limited to, a dividing panel 54, compressor 30, outdoor coil 26, etc.

Although the actual design of drain pan 14 may vary, channels 16 and 18, in this example, share a common wall between them, i.e., dividing wall 42. Wall 42 can be solid, as shown, or wall 42 can be hollow underneath (e.g., an inverted channel or upside-down-U). To promote the flow of condensate along drain pan 14, first channel 16 slopes downward in a first direction 54 (FIGS. 8 and 9) from a high point 56 down to an intermediate area 58, and second channel 18 slopes downward in a second direction 60 from intermediate area 58 down to a low point 62. First drain outlet 20 is at intermediate area 58, and second drain outlet 22 is at low point 62.

Figure 10:
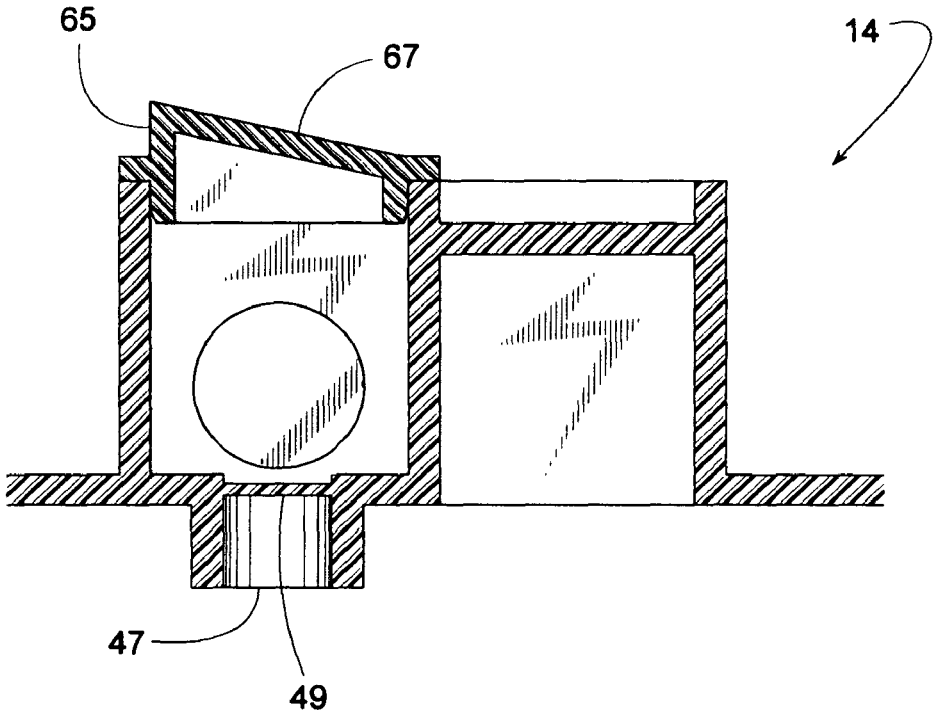
FIG. 10 is a cross-sectional view similar to FIG. 6 but showing an optional cap installed.

When dam 46 is in its intact position (FIGS. 2, 4, 7 and 8), dam 46 helps prevent condensate from flowing from channel 16 to channel 18, thus condensate 44 flows from high point 56, along channel 16, to intermediate area 58, and out through first drain outlet 20. In this configuration, an optional cap 64 (FIG. 6) may be installed to cover second drain outlet 22, or outlet 22 could be left open. When only first channel 16 is being used, leaving outlet 22 and/or outlet 4 open helps prevent stagnation of incidental condensate that might happen to enter second channel 18. Some examples of the invention, as shown in FIG. 10, include a cap 65 or shield that impedes condensate from dripping down into second channel 18. Cap 65 can be a separate removable piece, as shown, or cap 65 can be in the form of a shield extending from coil 14. In some examples of the invention, some condensate-passing clearance exists between the coil's lower edge 40 and dividing wall 42, and an upper surface 67 of cap 65 is sloped to direct condensate through that clearance into first channel 16. Cap 65, if used, preferably extends the full length and width of second channel 18.

Figure 8:
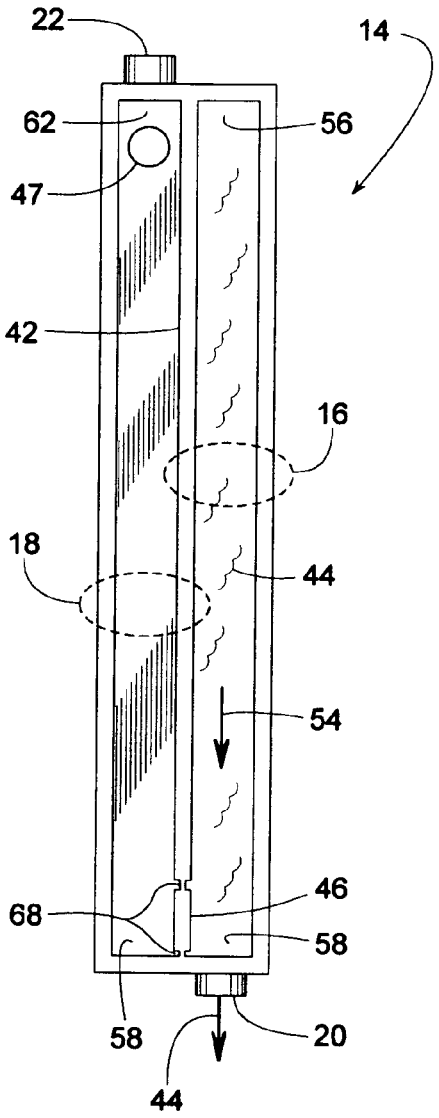
FIG. 8 is a top view of a portion of the drain pan with the dam intact position.
Figure 9:
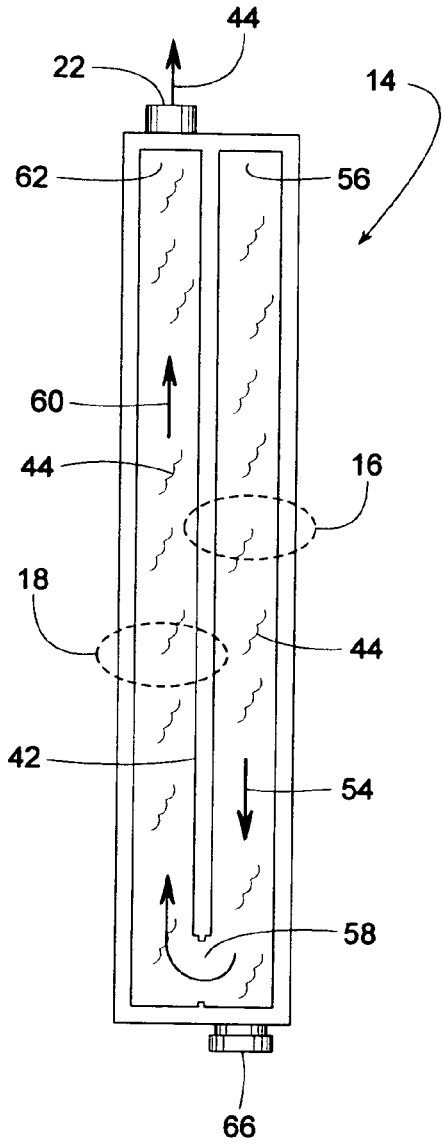
FIG. 9 is a top view of a portion of the drain pan with the dam removed.

When dam 46 is removed from its intact position (FIGS. 2, 4, 7 and 8) to a dislodged position (FIGS. 3, 5, and 9) and a cap 66 plugs first drain outlet 20, condensate flows sequentially from high point 56, down along channel 16 in first direction 54, across intermediate area 58, down along second channel 18 in second direction 60, and out through second drain outlet 22. In this configuration, condensate 44 in channels 16 and 18 flow in generally opposition directions 54 and 60, as shown in FIG. 9. As best seen in FIGS. 8 and 9, the generally opposite directions 54 and 60 allow high point 56 to be physically closer to low point 62 than to intermediate area 58. Such a physical arrangement of elements makes the channel portions of drain pan 14 compact and generally linear and thus suitable for fitting underneath the generally linear lowest edge 40 of cooling coil 12.

In this example, a breakable connection 68 (FIG. 8) connects dam 46 to the rest of drain pan 14, so moving dam 46 from its intact position to its dislodged position involves permanently breaking the edges of dam 46 away from drain pan 14. In some examples, breakable connection 68 comprises edges of dam 46 that are relatively thin and breakable. Such thinner edges can be referred to as a "mash off" and dam 46 might be referred to as a "knockout".

To minimize moisture condensing on the surface of drain pan 14 itself, drain pan 14 preferably has a lower thermal conductivity than that of cooling coil 12. In examples where drain pan 14 is comprised of a thermoset polymer, rather than a thermoplastic polymer, drain pan 14 has the thermal resistance to support an optional electric heater 70 in proximity with supply air outlet 52 immediately downstream of a discharge opening 72 of blower 24. Heater 70 can be particularly useful in reheating supply air that has been subcooled for dehumidification purposes.

In some embodiments, cooling coil 12 includes brackets 74 for holding an air filter 76 upstream of coil 12.

Although the invention is described with respect to a preferred embodiment, modifications thereto will be apparent to those of ordinary skill in the art. The scope of the invention, therefore, is to be determined by reference to the following claims:

The invention claimed is:

1. A refrigerant system subject to condensate, the refrigerant system comprising:

a cooling coil;

a drain pan disposed underneath the cooling coil at a position to collect condensate draining from the cooling coil, the drain pan includes a first channel and a second channel, the first channel slopes downward in a first direction from a high point to an intermediate area, the second channel slopes downward in a second direction from the intermediate area to a low point; and a dam selectively disposable at an intact position and a dislodged position such that in the intact position the dam is at the intermediate area to block condensate from flowing from the first channel to the second channel, and in the dislodged position the dam allows condensate to flow from the first channel to the second channel.

2. The refrigerant system of claim 1, further comprising a breakable connection that connects the dam to the intermediate area, wherein moving the dam from the intact position to the dislodged position involves permanently breaking the breakable connection.

3. The refrigerant system of claim 1, wherein the dam is spaced apart from the intermediate area when the dam is in the dislodged position.

4. The refrigerant system of claim 1, wherein the high point is closer to the low point than to the intermediate area.

5. The refrigerant system of claim 1, wherein the drain pan defines a first drain outlet and a second drain outlet, the first drain outlet is in proximity with the intermediate area, and the second drain outlet is in proximity with the low point.

6. The refrigerant system of claim 1, wherein the drain pan defines a return air inlet and a supply air outlet, and the first channel and the second channel are situated between the return air inlet and the supply air outlet.

7. The refrigerant system of claim 6, further comprising a blower supported by the drain pan, the blower creates a current of air flowing from the return air inlet to the supply air outlet, the second channel is upwind of the first channel with respect to the current of air.

8. The refrigerant system of claim 1, wherein the first channel and the second channel share a common wall therebetween.

9. The refrigerant system of claim 8, wherein the cooling coil is in intimate sealing contact with the common wall.

10. The refrigerant system of claim 1, wherein the drain pan including the first channel, the second channel and the dam is comprised of a monolithic unitary piece of a thermoset polymer that has a lower thermal conductivity than that of the cooling coil.

11. The refrigerant system of claim 10, wherein the drain pan defines a supply air outlet, the refrigerant system further comprising:

a heater supported by the drain pan in proximity with the supply air outlet; and a blower having a discharge opening facing the supply air outlet with the heater being interposed between the discharge opening and the supply air outlet.

12. The refrigerant system of claim 1, further comprising:

a compressor supported by the drain pan;

an outdoor coil supported by the drain pan; and a fan disposed in air-fluid communication with the outdoor coil.

13. A refrigerant system subject to condensate, the refrigerant system comprising:

a cooling coil;

a drain pan disposed underneath the cooling coil at a position to collect condensate draining from the cooling coil, the drain pan includes a first channel and a second channel, the first channel slopes downward in a first direction from a high point to an intermediate area, the second channel slopes downward in a second direction from the intermediate area to a low point, wherein the high point is closer to the low point than to the intermediate area;

a dam selectively disposable at an intact position and a dislodged position such that in the intact position the dam is at the intermediate area to block condensate from flowing from the first channel to the second channel, and in the dislodged position the dam is spaced apart from the intermediate area and allows condensate to flow from the first channel to the second channel; and a breakable connection that connects the dam to the intermediate area, wherein moving the dam from the intact position to the dislodged position involves permanently breaking the breakable connection.

14. The refrigerant system of claim 13, wherein the drain pan defines a first drain outlet and a second drain outlet, the first drain outlet is in proximity with the intermediate area, and the second drain outlet is in proximity with the low point.

15. The refrigerant system of claim 13, wherein the drain pan defines a return air inlet and a supply air outlet, and the first channel and the second channel are situated between the return air inlet and the supply air outlet.

16. The refrigerant system of claim 15, further comprising a blower supported by the drain pan, the blower creates a current of air flowing from the return air inlet to the supply air outlet, the second channel is upwind of the first channel with respect to the current of air.

17. The refrigerant system of claim 13, wherein the first channel and the second channel share a common wall therebetween.

18. The refrigerant system of claim 17, wherein the cooling coil is in intimate sealing contact with the common wall.

19. The refrigerant system of claim 13, wherein the drain pan including the first channel, the second channel and the dam is comprised of a monolithic unitary piece of a thermoset polymer that has a lower thermal conductivity than that of the cooling coil.

20. A refrigerant system subject to condensate, the refrigerant system comprising:

a cooling coil;

a drain pan comprising a monolithic unitary piece of a thermoset polymer that has a lower thermal conductivity than that of the cooling coil, the drain pan is disposed underneath the cooling coil at a position to collect condensate draining from the cooling coil, the drain pan includes a first channel and a second channel, the first channel slopes downward in a first direction from a high point to an intermediate area, the second channel slopes downward in a second direction from the intermediate area to a low point, wherein the high point is closer to the low point than to the intermediate area, the drain pan defines a first drain outlet in proximity with the intermediate area and a second drain outlet in proximity with the low point, the drain pan defines a return air inlet and a supply air outlet, the first channel and the second channel are situated between the return air inlet and the supply air outlet;

a dam selectively disposable at an intact position and a dislodged position such that in the intact position the dam is at the intermediate area to block condensate from flowing from the first channel to the second channel, and in the dislodged position the dam is spaced apart from the intermediate area and allows condensate to flow from the first channel to the second channel;

a breakable connection that connects the dam to the intermediate area, wherein moving the dam from the intact position to the dislodged position involves permanently breaking the breakable connection; and a blower supported by the drain pan, the blower creates a current of air flowing from the return air inlet to the supply air outlet, the second channel is upwind of the first channel with respect to the current of air.

* * * * *